United States Patent [19]

Burgers

[11] Patent Number: 4,781,139

[45] **Date of Patent: * Nov. 1, 1988**

[54] ONE MAN MANUAL BOAT HULL CLEANING DEVICE

[76] Inventor: John Burgers, P.O. Box 2101, Santa Cruz, Calif. 95063

[ * ] Notice: The portion of the term of this patent subsequent to Mar. 10, 2004 has been disclaimed.

[21] Appl. No.: 897,270

[22] Filed: Aug. 18, 1986

[51] Int. Cl.[4] ..... B63B 59/08

[52] U.S. Cl. ..... 114/222; 15/244.1

[58] Field of Search ..... 114/222; 15/244 R

[56] References Cited

U.S. PATENT DOCUMENTS 834,399 10/1906 McLellan et al. ..... 114/222

3,010,420 11/1961 Glynn ..... 114/222

4,407,213 10/1983 Evans ..... 114/222

4,648,344 3/1987 Burgers et al. ..... 114/222

*Primary Examiner*—Joseph F. Peters, Jr.

*Assistant Examiner*—Thomas J. Brahan

*Attorney, Agent, or Firm*—Allston L. Jones

[57] ABSTRACT

A device for scrubbing marine growth from the submerged portion of a boat hull. The device being particularly concerned with manual operation by one person from deck or dock side and comprising handle attached to a flexible buoyant base to which is fastened on one of its surfaces, a scrubbing material which when moved about on the submerged portions of a boat's hull scrubs therefrom unwanted marine growth.

9 Claims, 1 Drawing Sheet

ONE MAN MANUAL BOAT HULL CLEANING DEVICE

CROSS REFERENCE

This application is related to an application for U.S. Letters Patent entitled BOAT HULL CLEANING DEVICE, having been filed on July 5, 1985, and assigned Ser. No. 752,486 now U.S. Pat. No. 4,648,344 of which the inventor of the invention disclosed herein is one of the two inventors of the cross-referenced application. The inventor herein is also the owner of all rights in the cross-referenced application by assignment recorded in the U.S. Patent and Trademark Office on Oct. 22, 1984, on Reel 4318 at Frame 402.

BACKGROUND AND SUMMARY OF THE INVENTION

The importance of keeping the submerged portions of a boat's hull free of marine growth lies in the fact that the growth causes hull drag which results in slowing the boat's passage through water.

At the present time, there are in general practice, two methods for removing unwanted marine growth from the submerged portions of boat hulls. The first is to remove the boat from the water by means of a hoist, trailer or by beaching. The patent applied for here does not concern boats which have been moved to dry land and this common method of attaining access to a boat's hull for cleaning is mentioned only because it is inconvenient, time consuming and in the case of using a marine hoist, costly.

The second commonly employed method is for a diver to swim beneath the boat and clean the hull by means of a hand held brush or other abrasive material. This method when employing professional divers can be costly and in any event is time consuming. This method is mentioned here because it is the function of the present invention to perform the same scrubbing action without the necessity of having a diver enter the water.

The device of the cross-referenced application is a three-layered device for use by a single person from aboard ship or dock side. It is desirable to produce a one man hull cleaning device which has as few parts and is as lightweight as possible. The present invention is believed to be such a device.

In accordance with the present invention there is shown a one man, manually operable boat hull cleaning device. The device includes a flexible, buoyant base with at least one polygonally shaped continuous surface. The material of the base is selected to substantially retain its surface dimensions in both tension and compression created by manually applied forces. In addition, a scrubbing material is affixed to a surface of the base to perform the removal of marine growth from the hull of the boat. Further there is a grasping means affixed to the base for manually imparting movement to the device in both tension and compression.

DESCRIPTION OF THE PREFERRED EMBODIMENT

Figure 1:
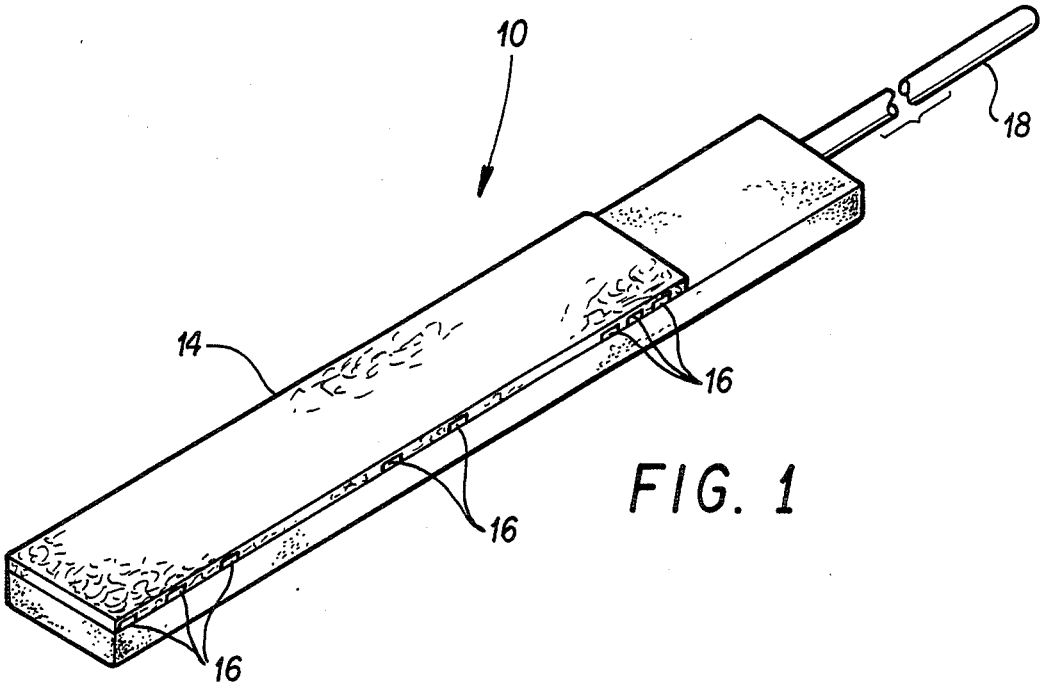
FIG. 1 is a perspective view of the present invention.

In the perspective view of FIG. 1 there can be seen a boat hull cleaning device 10 of the present invention which includes a flexible base 12, a sheet of scrubbing material 14, fastening strips 16, and handle means 18. Base 12, in the illustrated configuration of FIG. 1 is substantially longer than it is wide or thick, and it is on the order of three or four times as wide as it is thick. The material of base 12 further includes a substantial amount, by volume, of a trapped gas such as air. In the prototypical investigations of this invention the material selected by the inventor for base 12 was closed cell plastic foam that is 42 inches in length, 6 inches in width and 2 inches in thickness. Scrubbing material 14 is shown as a rectangular piece of material shaped and sized to be no longer or wider than one of the widest faces of base 12 and fastened thereto. During the prototypical investigation of the idea, a rectangular section of a fibrous fluorocarbon abrasive material, such as that sold under the trademark SCOTCHBRITE owned by 3M Company, was selected for scrubbing material 14.

Fastening strips 16 are used to join the scrubbing material sheet 14 to base 12. By using fasteners instead of glue, the scrubbing sheet 14 can be easily replaced when it wears out. Also in the prototypical investigation, dual lock VELCRO material was used for fastener strips 16 to facilitate the mounting of the fastener strips 16 on base 12 and the capture of scrubbing sheet 14.

The device is completed by the addition of a handle 18 to one of the short side edges of base 12. The handle may be attached in numerous ways. In the prototypical configuration, handle 18 was selected to be a length of PVC plastic pipe that was pressed into the end of base 12 and held in place by friction. For storage and ease of handling when the device is not in use, handle 18 can be made removable.

Figure 2:
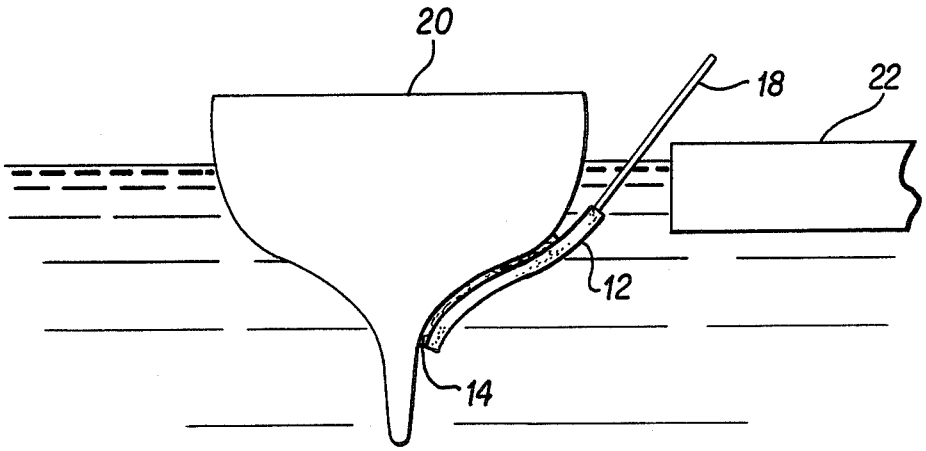
FIG. 2 is plan view of the present invention in use.

FIG. 2 illustrates the use of the boat hull scrubber of the present invention. The figure shows a boat 20 having its hull scrubbed by the present invention. As a result of the configuration of the invention, it can be seen that it may be used either from a dock or from the deck of the boat itself to perform the cleaning operation. To use the present invention, it is pressed into the water beside the boat with the scrubbing pad toward the surface of the hull. As a result of the buoyancy and flexibility of base 12, the scrubbing sheet 14 is forced up against the boat hull and flexs to conform to the shape of the boat. To produce this result the dimensions of base 12 are selected so that the length and width of the surface of the base 12 to which the scrubbing material 14 is fastened are each several magnitudes greater than the thickness of the base. This insures that flexure about the axes parallel to the length and width of the base occurs more readily than flexure about the axis parallel to thickness of the base. The greater the magnitude of the difference between the dimensions of the thickness, and the width and length of the base 12 the more improbable flexure about the axis parallel to the thickness of base 12 becomes.

While there has been shown and described the preferred embodiment of the present invention, it will be apparent to those skilled in the art that many changes and modifications may be made without departing from the invention in its broader aspects. Therefore, the appended claims are intended to cover all such modifications and changes that fall within the true spirit and scope of the invention.

What is claimed is:

1. A one-man manually operable device for cleaning marine growth from submerged portions of a boat hull, comprising:

an elongated, flexible, buoyant base having a substantial length to width ratio, and having opposite surfaces thereon and opposite proximate and distal ends along the length thereof, wherein said base is of a length to extend a substantial distance downwardly along, and to substantially conform to the shape of, the side of a boat hull from a point at the upper edge thereof and of a selected material such that the dimensions of its shape remain substantially unchanged in tension and compression created by manually applied forces thereto;

scrubbing means affixable to a substantial portion of one surface of the base for cleaning marine growth from the hull of the boat; and handle means affixable to the base for underwater extension and manual manipulation of said base in tension and compression to clean the hull of the boat, said handle means being a single elongated operator's handle affixed only to and extending from the proximate base end, with said distal end of the base being free of any operating handle means thereon;

said base having sufficient rigidity in a direction along its length so as to permit ready manual manipulation by said single handle of said base in the water proximate to a boat hull to position the said distal base end at a furthermost distance of said base from said handle at a desired location with respect to said hull notwithstanding inherent forces on said base to fold and buckle the base by the buoyancy thereof as said base is manually inserted and immersed downwardly in water;

said base having sufficient flexibility continuously over its entire length to permit limited bending thereof in a direction parallel to the base width in response to buoyant forces thereon when submerged, thereby to permit said base to substantially accommodate curvature of the boat hull;

whereby when said base is submerged into water adjacent a boat hull with said one base surface scrubbing material proximate the boat hull, said handle and said base rigidity permitting desired positioning of said base and distal base end for cleaning a hull area, and said base buoyancy effects limited flexing thereof under buoyant pressure so as to substantially conform said base along its length to curvature of said boat hull thereby to place said scrubbing material in contact with said hull, whereby manual manipulation of said handle to reciprocate said base in a direction along its length will effect cleaning of said hull.

2. A manual boat hull cleaning apparatus as in claim 1 further comprising fastening means for fastening said scrubbing means to said first surface of the base.

3. A manual boat hull cleaning apparatus as in claim 1 wherein said base has front and back surfaces both of the same geometric shape wherein the width and length of the front and back surfaces are substantially greater than the thickness of the base.

4. A manual boat hull cleaning apparatus as in claim 3 wherein the length of the front and back surfaces of the base is substantially greater than the width of the same surfaces.

5. A manual boat hull cleaning apparatus as in claim 3 wherein the length and width of the surfaces of the base are each several magnitudes greater in dimension than the thickness of the base such that flexure about the axis parallel to the length and width of the base surfaces readily occurs and flexure about the axis parallel to the thickness of the base is improbable.

6. A manual boat hull cleaning apparatus as in claim 4 wherein the length and width of the surfaces of the base are each several magnitudes greater in dimensions than the thickness of the base such that flexure about the axis parallel to the length and width of the base surfaces readily occurs and flexure about the axis parallel to the thickness of the base means is improbable.

7. A manual boat hull cleaning apparatus as in claim 3 wherein the combined length of the base and the handle means is sufficiently long to reach at least to the keel of the boat from above the surface of the water.

8. A manual boat hull cleaning apparatus as in claim 3 wherein said handle means is removable from the base to facilitate storage of the apparatus.

9. A manual boat hull cleaning apparatus as in claim 1 wherein the base is constructed of a closed cell plastic foam having a gas trapped therein and dispersed throughout said material.

* * * * *